US010800583B2

(12) United States Patent
Chen

(10) Patent No.: US 10,800,583 B2
(45) Date of Patent: Oct. 13, 2020

(54) SCREW PACKING CONTAINER

(71) Applicant: Yi-Hsin Chen, Kaohsiung (TW)

(72) Inventor: Yi-Hsin Chen, Kaohsiung (TW)

( * ) Notice: Subject to any disclaimer, the term of this patent is extended or adjusted under 35 U.S.C. 154(b) by 33 days.

(21) Appl. No.: 16/228,648

(22) Filed: Dec. 20, 2018

(65) Prior Publication Data

US 2020/0198849 A1 Jun. 25, 2020

(51) Int. Cl.
*B65D 43/16* (2006.01)
*B25H 3/02* (2006.01)

(52) U.S. Cl.
CPC ..... *B65D 43/161* (2013.01); *B25H 3/02* (2013.01); *B65D 2543/00194* (2013.01); *B65D 2543/00648* (2013.01); *B65D 2543/00722* (2013.01)

(58) Field of Classification Search
CPC ..... B65D 43/161; B65D 2543/00194; B65D 2543/00648; B65D 2543/00722; B65D 43/0204; B65D 43/0212; B65D 43/0208; B25H 3/02
USPC ..... 220/826, 254.2, 258.2, 270, 810; 206/338
See application file for complete search history.

(56) References Cited

U.S. PATENT DOCUMENTS 3,417,897 A * 12/1968 Johnson ..... B65D 43/161 220/254.3
3,904,074 A * 9/1975 Hoffman ..... B65D 43/0212 220/258.3
4,369,901 A * 1/1983 Hidding ..... B65D 47/0852 222/142.7
4,881,668 A * 11/1989 Kitterman ..... B65D 47/0876 222/482
7,165,695 B2 * 1/2007 Choi ..... B25H 3/02 220/254.3
10,138,031 B2 * 11/2018 Del Rosario Roy ..... B65D 21/0209
10,196,183 B2 * 2/2019 Chen ..... B65D 43/161
10,252,839 B2 * 4/2019 Chen ..... B65D 43/24
10,589,909 B2 * 3/2020 Daggett ..... B65D 83/06
2006/0151512 A1 * 7/2006 Van Heugten ..... B65D 43/161 220/826
2008/0083768 A1 * 4/2008 Luburic ..... B65D 43/161 220/810
2011/0024421 A1 * 2/2011 Luburic ..... B65D 25/32 220/265
2012/0279969 A1 * 11/2012 Antal, Sr. ..... B65D 43/161 220/315

* cited by examiner

*Primary Examiner* — Chun Hoi Cheung
(74) *Attorney, Agent, or Firm* — J.C. Patents

(57) ABSTRACT

A screw packing container includes at least a semi-open lid and a container, said lid has a first section and a second section which are connected by a hinge. Even if the user opens the first section of the lid very vigorously, the innovative barb fixing technique used in the second section of the lid can surely prevent the entire lid from being opened. Moreover, this invention utilizes the innovative double support positioning technology to enable the screw packing container still has the function of maintaining a semi-open state after being used for a long time. In this way, the use efficiency of the screw packing container can be improved, and the user can take the screws or other parts in the container more conveniently and safely.

13 Claims, 10 Drawing Sheets

SCREW PACKING CONTAINER

BACKGROUND OF THE INVENTION

1. Field of the Invention

This invention relates to a structural innovation of a screw packing container, particularly to a semi-open lid plastic container which can be used for storing various screw or small parts.

2. Description of the Prior Art

The prior semi-open lid screw container has two problems in use. First, when the user open the semi-open lid, he (her) needs to apply pressure to open the lid, if the force is too large, it will easily open the entire lid and lose the advantage of the simple open and close of the semi-open lid, so it is very inconvenient to use.

Second, the prior semi-open lid screw container is not easy to hold in the semi-open state. Each of the prior semi-open lid structure that remains in semi-open state will be excessively worn after being used for a period of time and lose the functionality of maintaining the lid in a semi-open place, this is a very difficult problem to overcome. Therefore, when the user puts his (her) hand into the semi-open lid screw container, his (her) hand will be nipped by the semi-open lid and affect the user to take the screws and small parts inside the container.

For this reason, the inventor of this invention, having much experience in designing and manufacturing all kinds of containers and its related products, understands and researches the problem of the foregoing prior art and hence devised this invention.

SUMMARY OF THE INVENTION

The objective of this invention is to offer an innovative barbed semi-open lid structure to prevent the user from unintentionally opening the entire lid. Moreover, through the innovative dual positioning technology, the semi-open lid has dual positioning effect and high support stability. Even if the semi-open lid has any support-positioning function failure after a long period of use, it will not affect the function of the semi-open lid to maintain the semi-open state, so as to improve the efficiency in the use of semi-open lid screw container.

The screw packing container in the present invention includes at least a semi-open lid and a container. Said lid has a first section and a second section which are connected by a hinge, the periphery of the first section and second section are respectively provided with a first circumferential wall and a second circumferential wall, a first recess is set on the inner surface of said first circumferential wall, a first supporting protrusion is mounted on the inner surface of the first circumferential wall which is close to said hinge; a second recess is set on the inner surface of said second circumferential wall, at least one anti-detachment block is mounted on the inner surface of the second circumferential wall which is close to said hinge, the anti-detachment block is disposed below the second recess; said first section and second section are respectively provided with a first prominent portion and a second prominent portion, at least one set first coupling member and second coupling member is mounted on the first prominent portion and second prominent portion which is close to said hinge, and the first coupling member and the second coupling member can be stuck with each other.

The screw packing container of present invention, among which said container has a space, the shape of the annular side wall of the container is in conformance with the shape of the lid, a engaging circumference is formed on the top of the container; the left side of said engaging circumference has a first engaging flange which is provided to match with said first recess, the right side of said engaging circumference has a second engaging flange which is provided to match with said second recess; when the second section of the lid and the container are engaged with each other, said anti-detachment block will hook the second engaging flange of the container so that the second section can be fixed with the container; a second supporting protrusion is mounted on the outer surface of said engaging circumference, the position of the second supporting protrusion is corresponding to the position of said first supporting protrusion, thus, by using the first supporting protrusion of the lid and the second supporting protrusion of the container, an auxiliary support for maintaining the first section in the open position can be provided, and the first section of the lid will achieve the effect of double support positioning.

The screw packing container of present invention, among which the rear end of the first supporting protrusion is provided with a first guiding slope to reduce the resistance of the first supporting protrusion during the closing lid operation. Said second supporting protrusion is provided with a third guiding slope, the third guiding slope is matched with said first supporting protrusion to reduce the resistance of the first supporting protrusion during the first section opening operation. A guiding block is mounted behind said second supporting protrusion, the guiding block has an arcuate guide angle to guide the first supporting protrusion to move more smoothly when the first section is opened.

The screw packing container of present invention, among which the lower end of the anti-detachment block is provided with a second guiding slope to reduce the closing resistance of the anti-detachment block to the second section of the lid.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
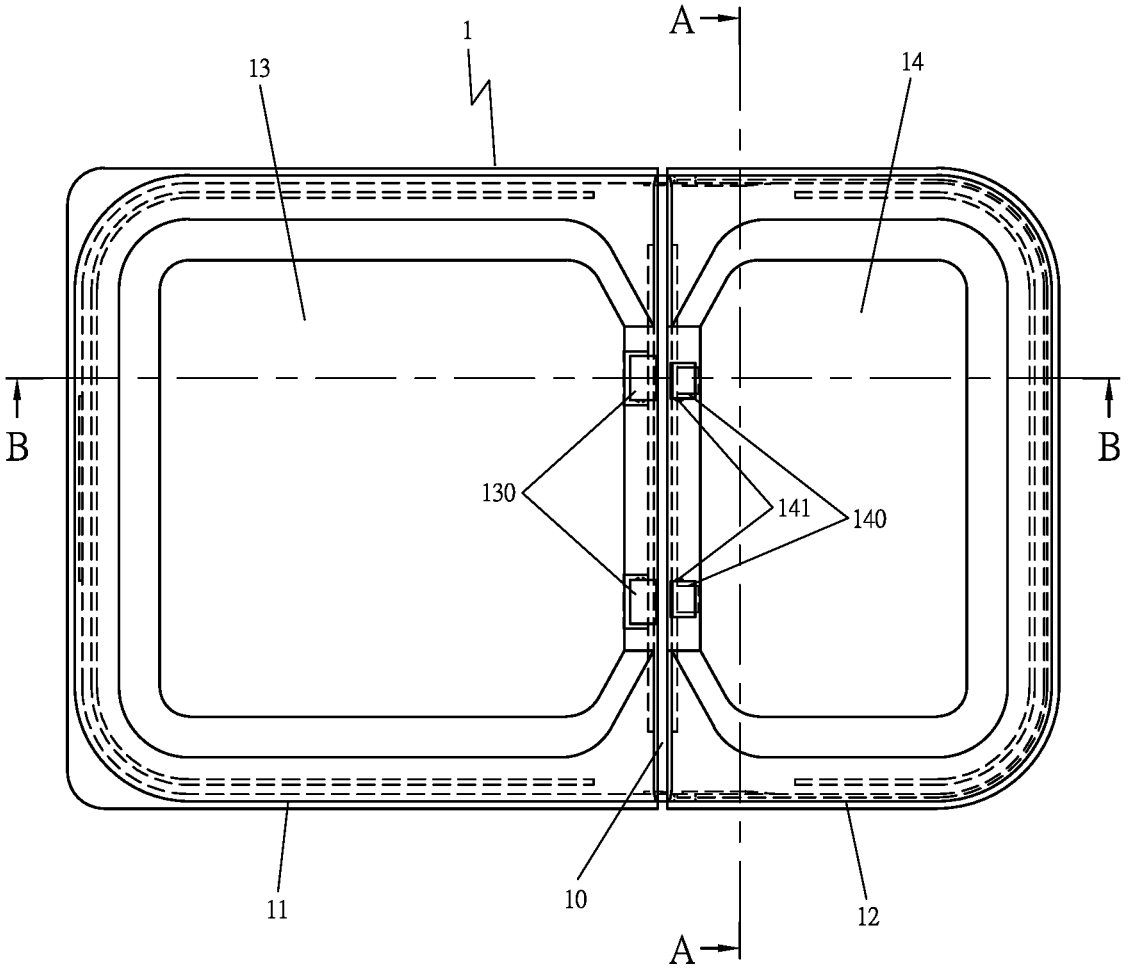
FIG. 1 is a top view in the present invention.

A preferred embodiment of a screw packing container in the present invention, as shown in FIG. 1-19, includes at least a lid 1 and a container 2 as main components combined together. The lid 1 and the container 2 can be made of plastic, rubber or other elastic material.

As shown in FIGS. 7 to 11, the lid 1 has a first section 11 and a second section 12 which are connected by a hinge 10. When the size of the first section 11 is larger than the size of the second section 12, the user can more conveniently take the screws or parts in the container 2.

The periphery of the first section 11 and second section 12 are respectively provided with a first circumferential wall 110 and a second circumferential wall 120, and a first reinforced ring 111 and a second reinforced ring 121 are separately arranged on the bottom of said first circumferential wall 110 and the bottom of second circumferential wall 120 to strengthen the structural strength of the circumferential wall 110, 120.

The inner side of the first circumferential wall 110 of the first section 11 is spaced apart by a distance to provide a first inner circumference 112, a first groove 113 is formed between the first circumferential wall 110 and the first inner circumference 112, and a first recess 114 is set on the inner surface of said first circumferential wall 110. A first supporting protrusion 115 is mounted on the inner surface of the first circumferential wall 110 which is close to said hinge 10, the first supporting protrusions 115 may be respectively disposed at the both ends of the first circumferential wall 110. The rear end of the first supporting protrusion 115 may be provided with a first guiding slope 116 to reduce the resistance of the first supporting protrusion 115 during the closing lid operation.

The inner side of the second circumferential wall 120 of the second section 12 is spaced apart by a distance to provide a second inner circumference 122, a second groove 123 is formed between the second circumferential wall 120 and the second inner circumference 122, and a second recess 124 is set on the inner surface of said second circumferential wall 120. Said first groove 113 and second groove 123 are engaged with each other to form an annular groove. At least one anti-detachment block 125 is mounted on the inner surface of the second circumferential wall 120 which is close to said hinge 10, the anti-detachment block 125 is disposed below the second recess 124. The lower end of the anti-detachment block 125 may be provided with a second guiding slope 126 to reduce the closing resistance of the anti-detachment block 125 to the second section 12 of the lid 1.

Figure 8:
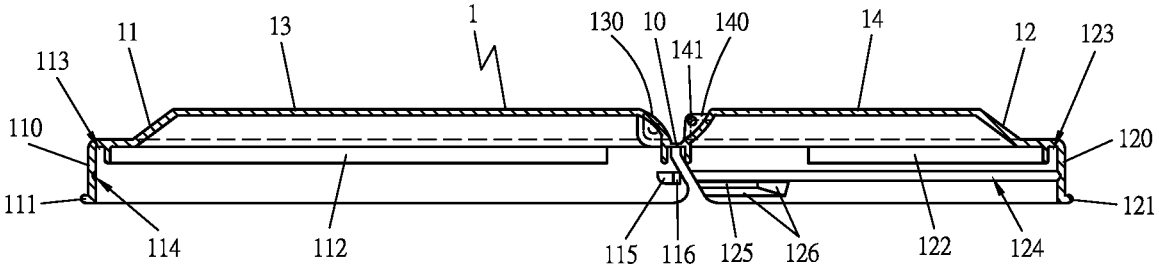
FIG. 8 is a cross-sectional view taken along line C-C of FIG. 7.
Figure 9:
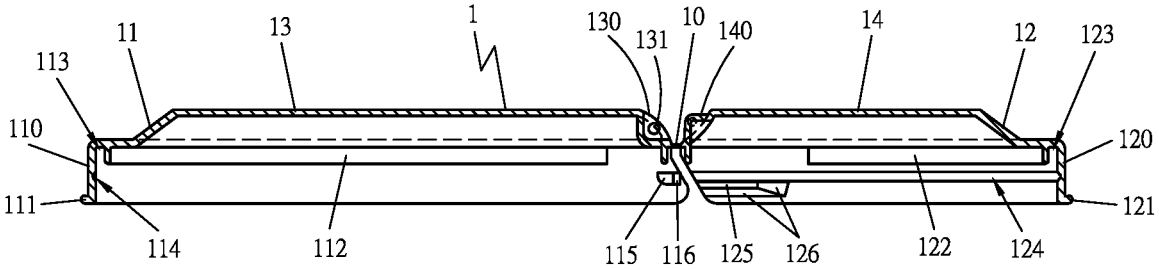
FIG. 9 is a cross-sectional view taken along line D-D of FIG. 7.
Figure 10:
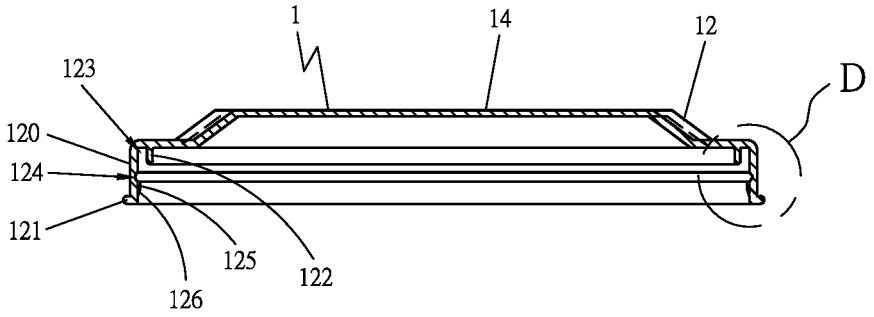
FIG. 10 is a cross-sectional view taken along line E-E of FIG. 7.
Figure 11:
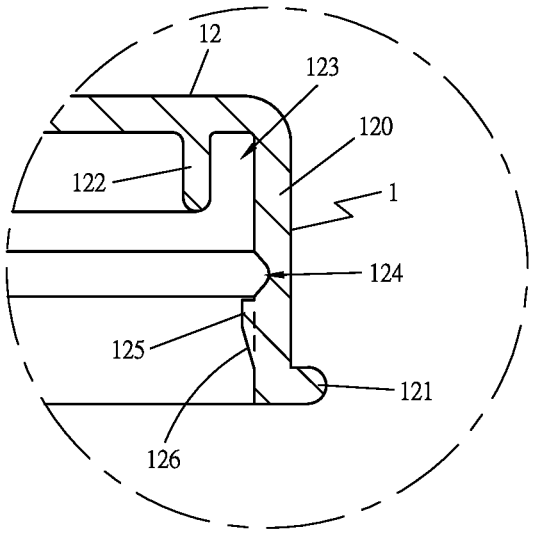
FIG. 11 is an enlarged view of area D shown in FIG. 10.
Figure 12:
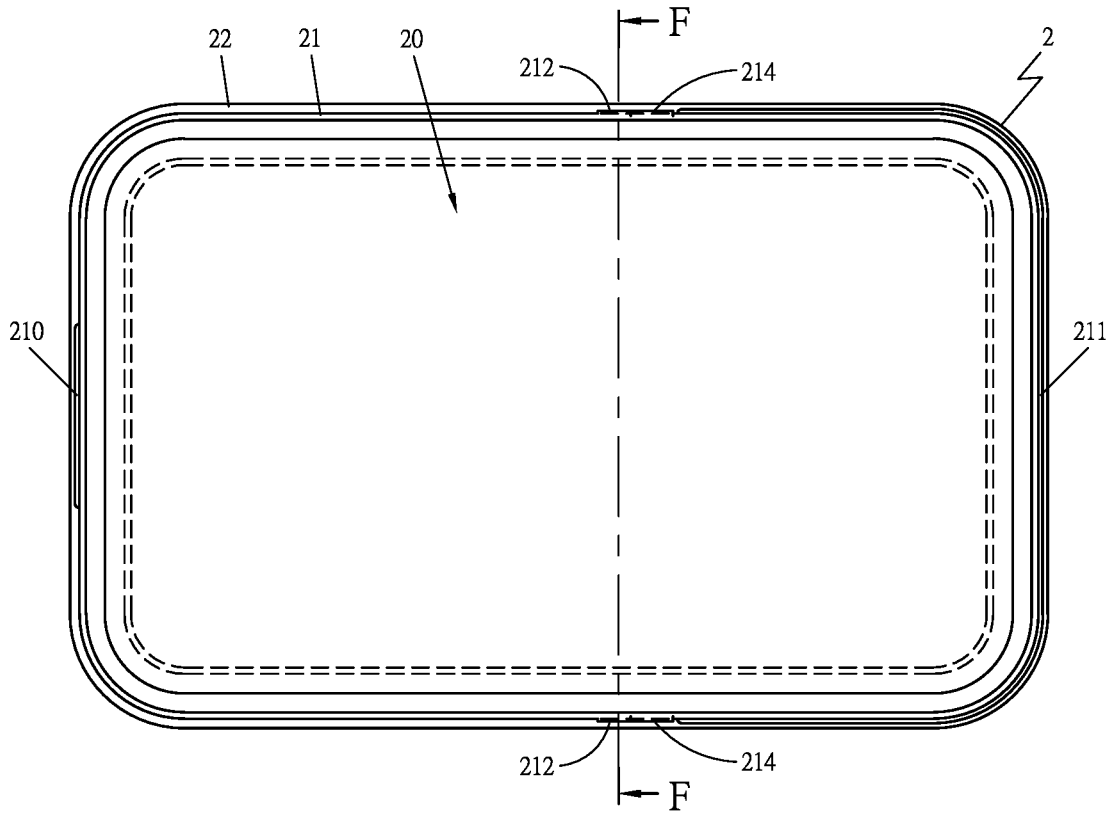
FIG. 12 is an top view of the container in the present invention.

Said first section 11 and second section 12 are respectively provided with a first prominent portion 13 and a second prominent portion 14, at least one set first coupling member 130 and second coupling member 140 is mounted on the first prominent portion 13 and second prominent portion 14 which is close to said hinge 10, and the first coupling member 130 and the second coupling member 140 can be stuck with each other. As shown in FIGS. 8 and 9, the first coupling member 130 and the second coupling member 140 may be a set of corresponding lug and groove, the lug and the groove are respectively provide with a first positioning member 131 and a second positioning member 141. In this way, when the lug is combined with the groove, an squeezing friction force is generated between the first positioning member 131 and the second positioning member 141, so that the first coupling member 130 and the second coupling member 140 can be stuck and positioned to each other.

As shown in FIGS. 12 to 16, said container 2 has a space 20 to contain screws or other parts, the shape of the annular side wall 200 of the container 2 is in conformance with the shape of the lid 1. A engaging circumference 21 is formed on the top of the container 2, a protrudent ring 22 is provided between the annular side wall 200 and the engaging circumference 21 to strengthen the structure of the container 2 and to limit the final engaging position and depth of the lid 1. So that the user can know whether the lid 1 has been tight with the container 2.

Figure 2:
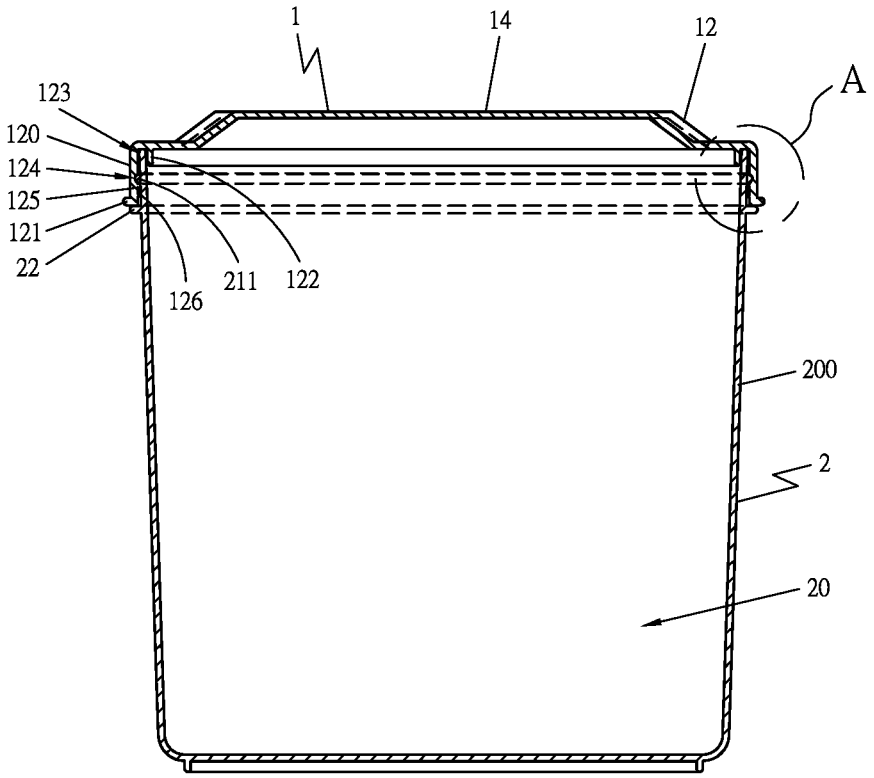
FIG. 2 is a cross-sectional view taken along line A-A of FIG. 1.
Figure 3:
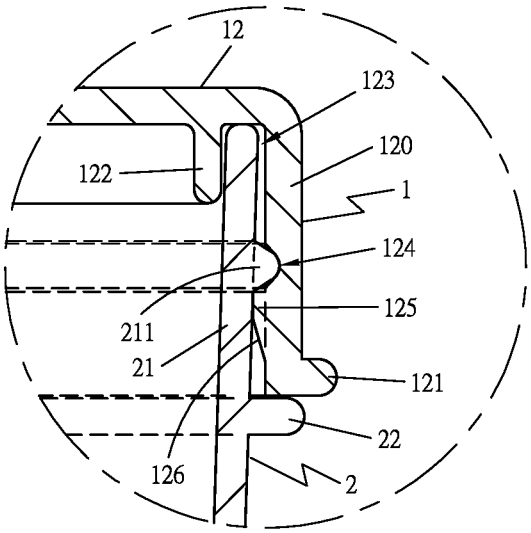
FIG. 3 is an enlarged view of area A shown in FIG. 2.
Figure 4:
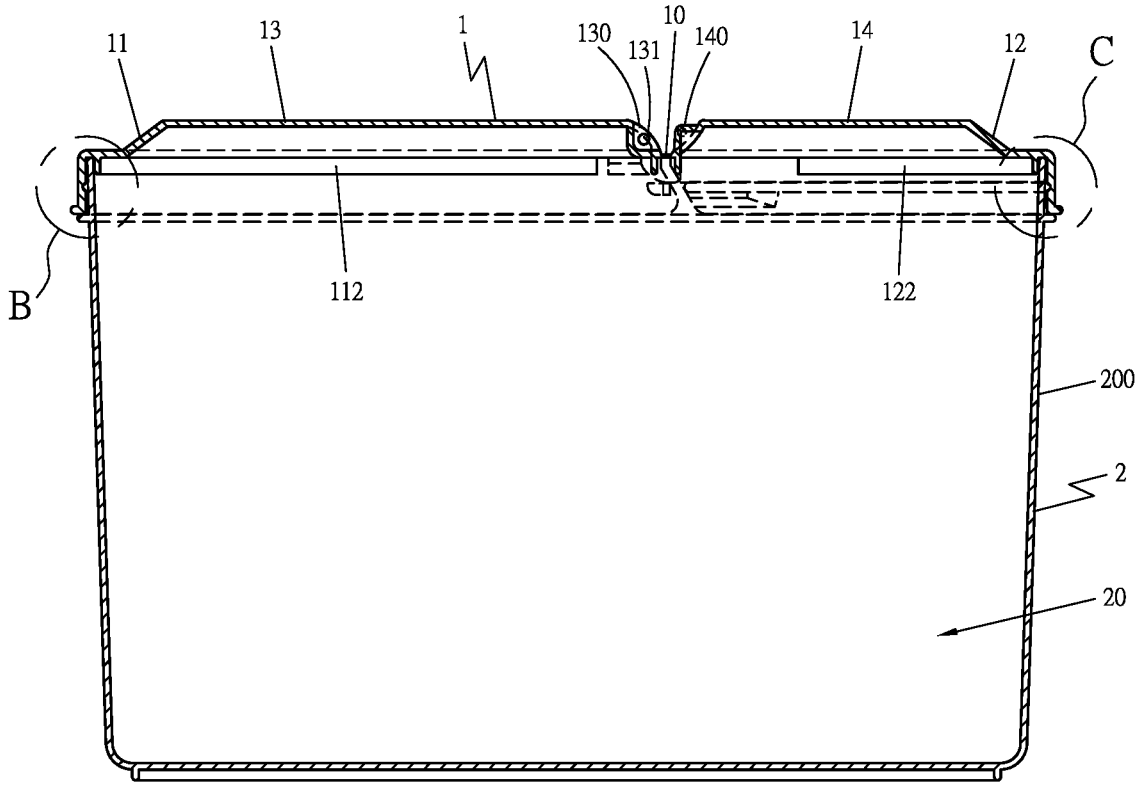
FIG. 4 is a cross-sectional view taken along line B-B of FIG. 1.
Figure 5:
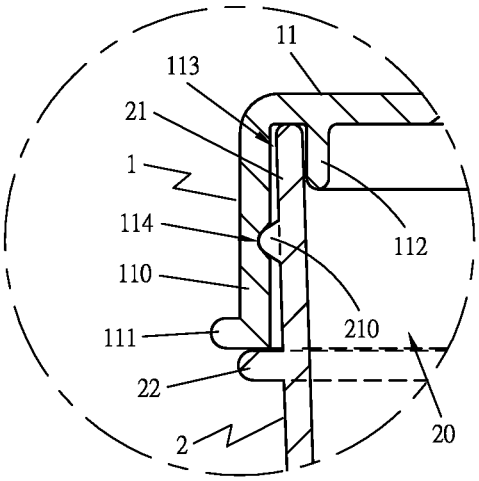
FIG. 5 is an enlarged view of area B shown in FIG. 4.
Figure 6:
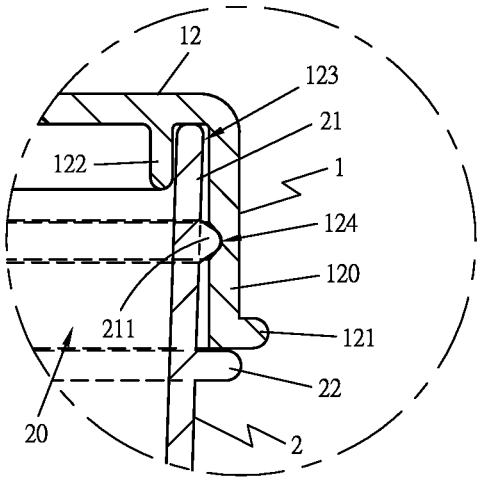
FIG. 6 is an enlarged view of area C shown in FIG. 4.
Figure 7:
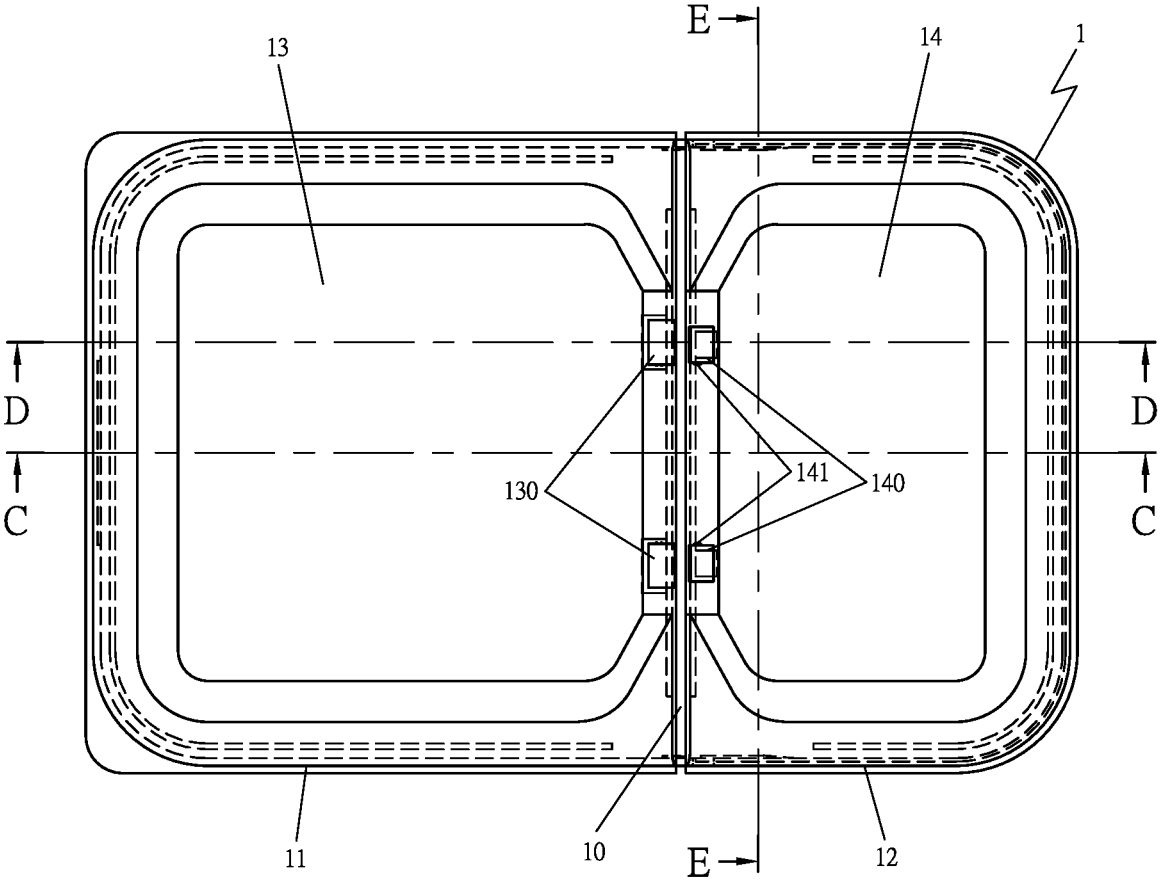
FIG. 7 is an top view of the lid in the present invention.
Figure 13:
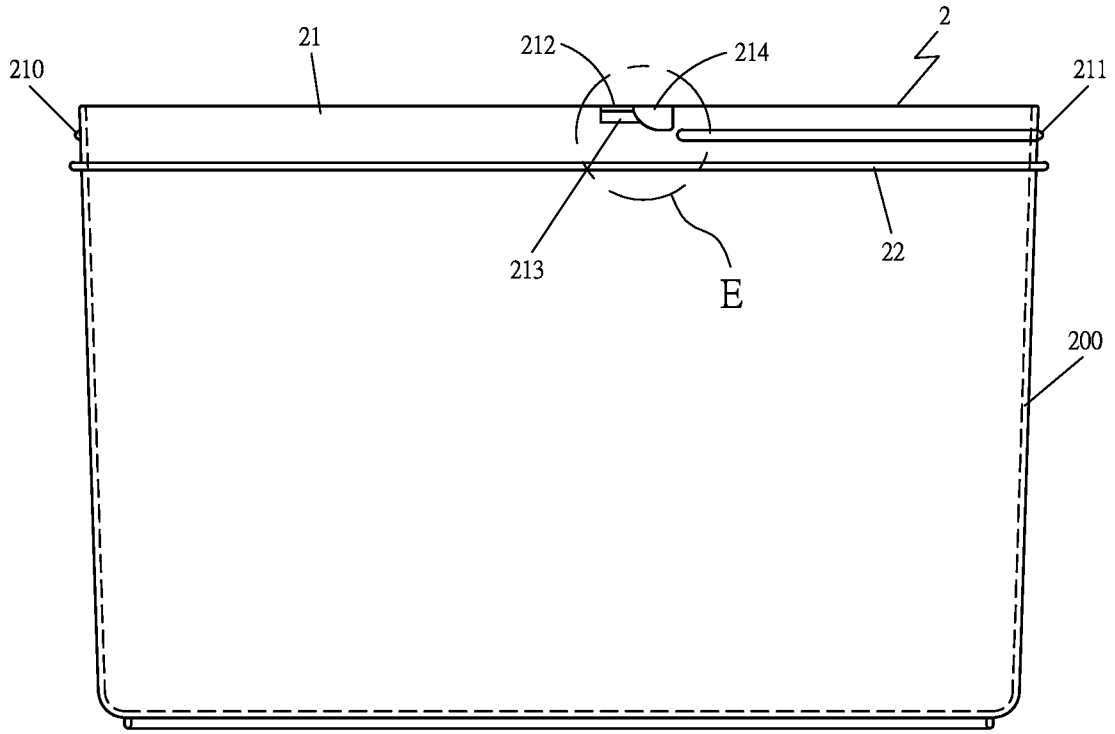
FIG. 13 is a front view of the container in the present invention.
Figure 14:
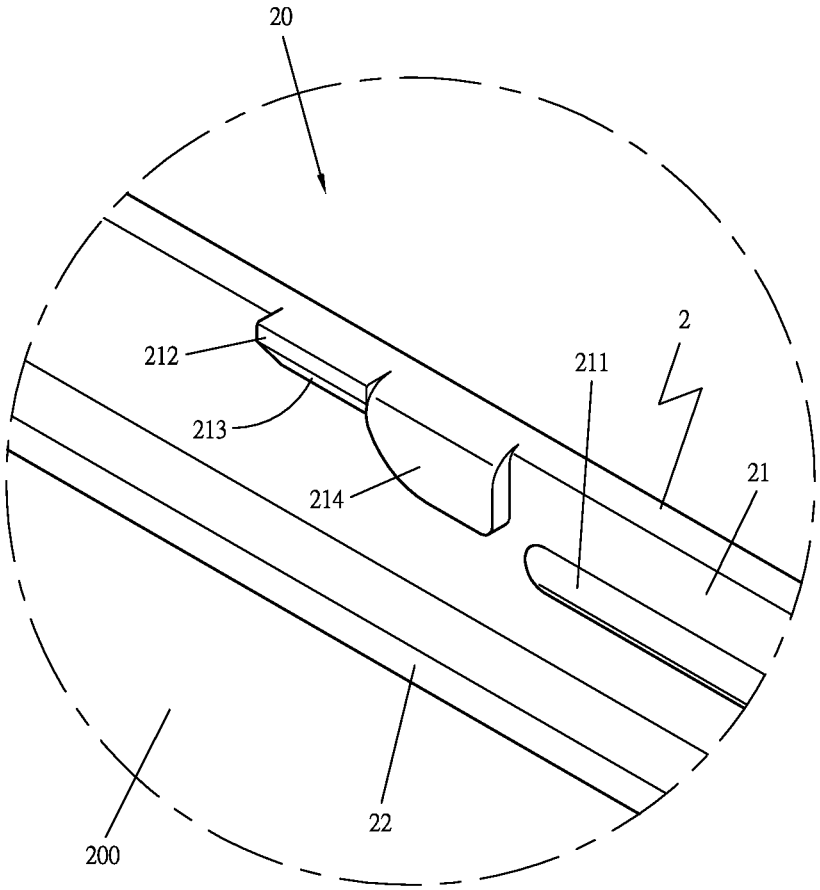
FIG. 14 is an enlarged view of area E shown in FIG. 13.
Figure 15:
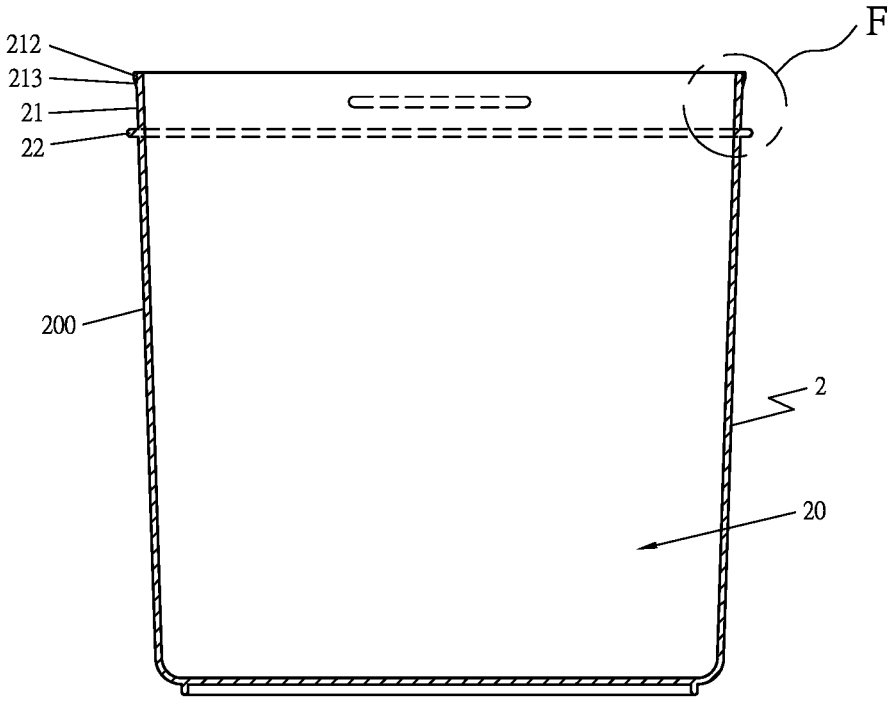
FIG. 15 is a cross-sectional view taken along line F-F of FIG. 12.
Figure 16:
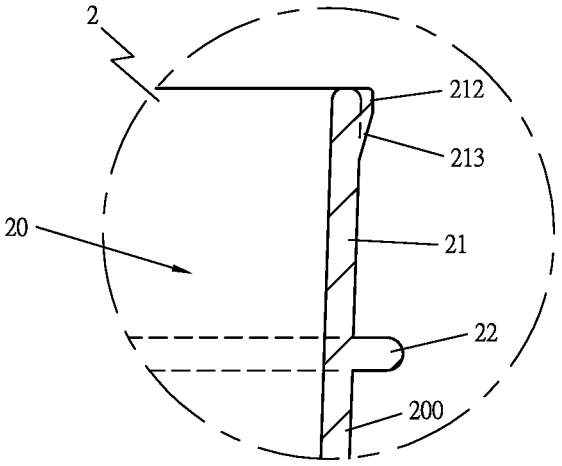
FIG. 16 is a partial enlarged view of the F area of FIG. 15.

As shown in FIG. 13, the left side of said engaging circumference 21 has a first engaging flange 210 which is provided to match with said first recess 114, so that the first section 11 of the lid 1 can be engaged with the container 2. The right side of said engaging circumference 21 has a second engaging flange 211 which is provided to match with said second recess 124, so that the second section 12 of the lid 1 can be engaged with the container 2. The total length of the first engaging flange 210 is less than the total length of the second engaging flange 211, so that the first section 11 will be easier to open than the second section 12. As shown in FIGS. 2 and 3, when the second section 12 of the lid 1 and the container 2 are engaged with each other, said anti-detachment block 125 will hook the second engaging flange 211 of the container 2, so that the second section 12 can be fixed with the container 2 and prevent the second section 12 from being accidentally opened.

As shown in FIGS. 13 to 16, a second supporting protrusion 212 is mounted on the outer surface of said engaging circumference 21, the position of the second supporting protrusion 212 is corresponding to the position of said first supporting protrusion 115. Thus, when the first section 11 of the lid 1 is opened, the first section 11 can be held in the open position by using the first coupling member 130 and the second coupling member 140, moreover, by using the first supporting protrusion 115 of the lid 1 and the second supporting protrusion 212 of the container 2, an auxiliary support for maintaining the first section 11 in the open position can be provided, so that the first section 11 of the lid 1 will achieve the effect of double support positioning, and also can extend the service life of the screw packing container.

Said second supporting protrusion 212 may be provided with a third guiding slope 213, the third guiding slope 213 is matched with said first supporting protrusion 115 to reduce the resistance of the first supporting protrusion 115 during the the first section 11 opening operation. A guiding block 214 may be mounted behind said second supporting protrusion 212, the guiding block 214 has an arcuate guide angle to guide the first supporting protrusion 115 to move more smoothly when the first section 11 is opened.

Figure 17:
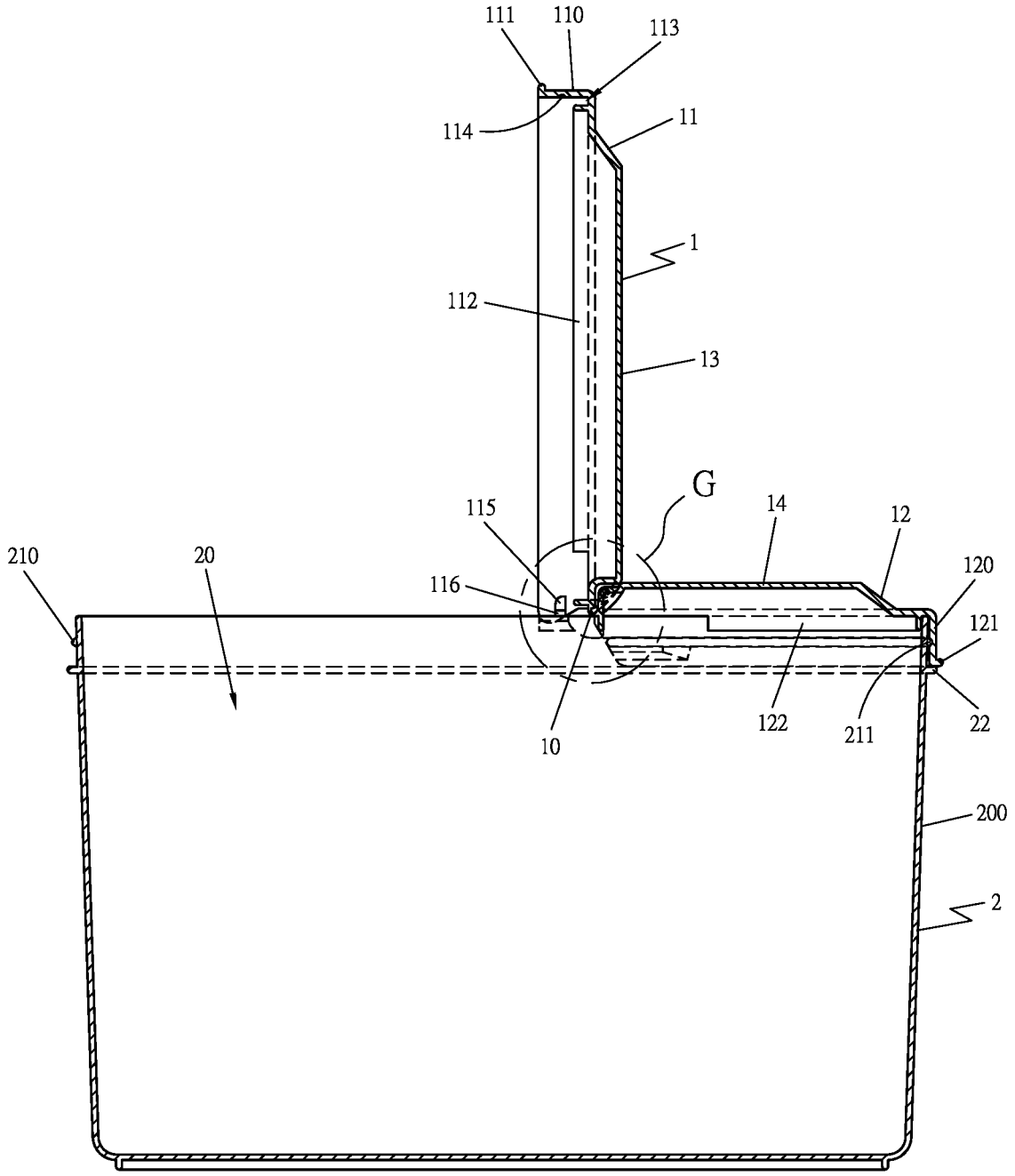
FIG. 17 is a cross-sectional view in the present invention showing the first section of the lid hold in the open state.
Figure 18:
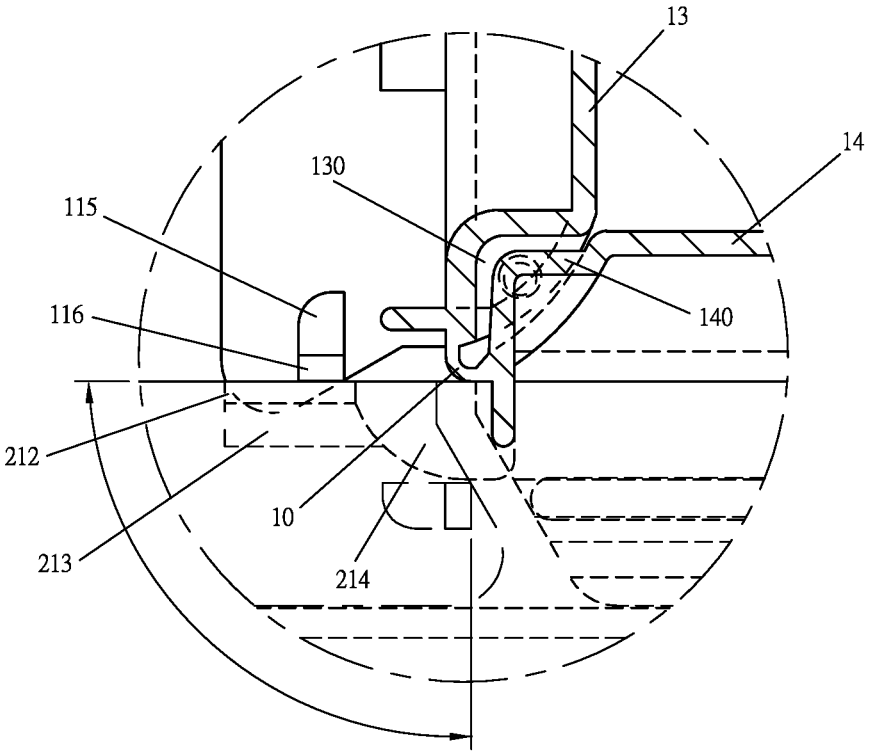
FIG. 18 is a partial enlarged view of the G area of FIG. 17.
Figure 19:
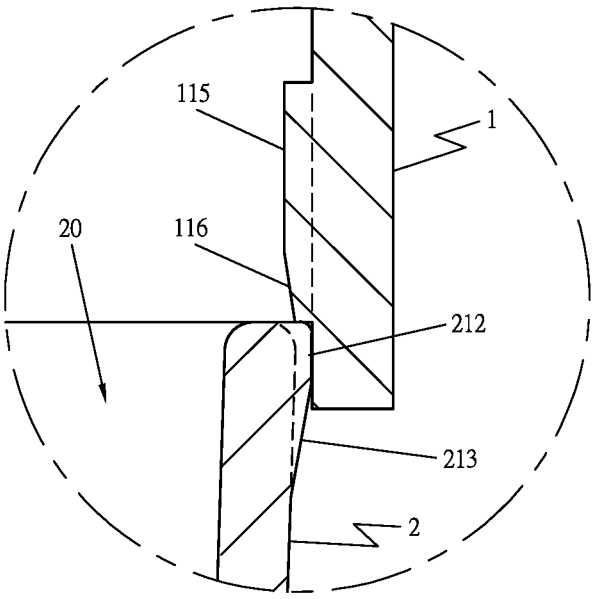
FIG. 19 is a schematic view of another perspective of the first supporting protrusion and the second supporting protrusion of FIG. 17.

As shown in FIGS. 17 to 19, when the screw packing container of the present invention is used, even if the user opens the first section 11 of the lid 1 very vigorously, the innovative barb fixing technique used in the second section 12 of the lid 1 can surely prevent the entire lid 1 from being opened. Moreover, this invention utilizes the innovative double support positioning technology to enable the screw packing container still has the function of maintaining a semi-open state after being used for a long time. In this way, the use efficiency of the screw packing container can be improved, and the user can take the screws or other parts in the container more conveniently and safely. Evidently this invention has tangible benefits and tallies with progressiveness and novelty demanded by patent laws.

While the preferred embodiments of this invention have been described above, it will be recognized and understood that various modifications may be made therein and appended claims are intended to cover all such modifications that may fall within the spirit and scope of the invention.

What is claimed is:

1. A screw packing container at least comprising:

a lid, having a first section and a second section which are connected by a hinge, wherein periphery of the first section and the second section is respectively provided with a first circumferential wall and a second circumferential wall, a first recess is set on an inner surface of said first circumferential wall, a first supporting protrusion is mounted on the inner surface of the first circumferential wall which is close to said hinge; a second recess is set on an inner surface of said second circumferential wall, at least one anti-detachment block is mounted on the inner surface of the second circumferential wall which is close to said hinge, the anti-detachment block is disposed below the second recess; said first section and second section are respectively provided with a first prominent portion and a second prominent portion, at least one set of first coupling member and second coupling member is mounted on the first prominent portion and second prominent portion which is close to said hinge;

a container, having a space, wherein a shape of an annular side wall of the container is in conformance with a shape of the lid, an engaging circumference is formed on a top of the container; a left side of said engaging circumference has a first engaging flange which is provided to match with said first recess, a right side of said engaging circumference has a second engaging flange which is provided to match with said second recess; when the second section of the lid and the container are engaged with each other, said anti-detachment block hooks the second engaging flange of the container; a second supporting protrusion is mounted on an outer surface of said engaging circumference, a position of the second supporting protrusion corresponds to a position of said first supporting protrusion, thus, by using the first supporting protrusion of the lid and the second supporting protrusion of the container, an auxiliary support for maintaining the first section in an open position is provided, and the first section of the lid achieves the effect of double support positioning.

2. The screw packing container according to claim 1, wherein a size of the first section is larger than a size of the second section.

3. The screw packing container according to claim 1, wherein a first reinforced ring and a second reinforced ring are separately arranged on a bottom of said first circumferential wall and a bottom of said second circumferential wall.

4. The screw packing container according to claim 1, wherein an inner side of the first circumferential wall of the first section is spaced apart by a distance to provide a first inner circumference, a first groove is formed between the first circumferential wall and the first inner circumference; an inner side of the second circumferential wall of the second section is spaced apart by a distance to provide a second inner circumference, a second groove is formed between the second circumferential wall and the second inner circumference.

5. The screw packing container according to claim 4, wherein said first groove and second groove together form an annular groove.

6. The screw packing container according to claim 1, wherein said first supporting protrusions is respectively disposed at both ends of the first circumferential wall.

7. The screw packing container according to claim 1, wherein a rear end of the first supporting protrusion is provided with a first guiding slope to reduce resistance of the first supporting protrusion during closing lid operation.

8. The screw packing container according to claim 1, wherein said second supporting protrusion is provided with a third guiding slope, the third guiding slope is matched with said first supporting protrusion to reduce resistance of the first supporting protrusion during first section opening operation.

9. The screw packing container according to claim 1, wherein a guiding block is mounted behind said second supporting protrusion, the guiding block has an arcuate guide angle to guide the first supporting protrusion to move more smoothly when the first section is opened.

10. The screw packing container according to claim 1, wherein a lower end of the anti-detachment block is provided with a second guiding slope to reduce closing resistance of the anti-detachment block to the second section of the lid.

11. The screw packing container according to claim 1, wherein the first coupling member and the second coupling member are a set of corresponding lug and groove, the lug and the groove are respectively provide with a first positioning member and a second positioning member; when the lug is combined with the groove, an squeezing friction force is generated between the first positioning member and the second positioning member.

12. The screw packing container according to claim 1, wherein a total length of the first engaging flange is less than a total length of the second engaging flange, so that the first section is easier to open than the second section.

13. The screw packing container according to claim 1, wherein a protrudent ring is provided between the annular side wall and the engaging circumference to strengthen the structure of the container and to limit a final engaging position and depth of the lid.

* * * * *